United States Patent [19]

Asada et al.

[11] 4,349,699

[45] Sep. 14, 1982

[54] SPEECH SYNTHESIZER

[75] Inventors: Akihiro Asada, Yokohama; Kazuo Nakata, Kodaira; Kazuhiro Umemura, Yokohama; Hirokazu Sato, Yokosuka; Kenya Murakami, Yokosuka; Kiyoshi Into, Yokosuka, all of Japan

[73] Assignees: Nippon Telegraph & Telephone Public Corporation; Hitachi, Ltd., both of Tokyo, Japan

[21] Appl. No.: 192,539

[22] Filed: Sep. 30, 1980

[30] Foreign Application Priority Data

Oct. 1, 1979 [JP] Japan ..... 54-125384

[51] Int. Cl.[3] ..... G10L 1/00

[52] U.S. Cl. ..... 179/1 SM

[58] Field of Search ..... 179/1 SM, 1 SA; 364/724, 725, 513, 514; 370/118

[56] References Cited

U.S. PATENT DOCUMENTS

| | | | |
|---|---|---|---|
| 3,662,115 | 5/1972 | Saito et al. | 179/1 SA |
| 4,022,974 | 5/1977 | Kohut et al. | 179/1 SM |
| 4,209,836 | 6/1980 | Wiggins et al. | 179/1 SM |
| 4,209,844 | 6/1980 | Brantingham | 179/1 SA |

*Primary Examiner*—Mark E. Nusbaum
*Assistant Examiner*—E. S. Kemeny
*Attorney, Agent, or Firm*—Craig and Antonelli

[57] ABSTRACT

This PARCOR-type speech synthesizer replaces a ten-stage lattice type filter with a pipeline multiplier and feedback loop, and provides a loss circuit (for bandwidth broadening) using subtraction circuits for multiplication.

2 Claims, 8 Drawing Figures

SPEECH SYNTHESIZER

The present invention relates to a speech synthesizer, and more particularly to a speech synthesizer for synthesizing a speech signal based on a parameter signal representing a frequency spectrum envelope of a voice signal and information representing a period of the voice signal.

In terminals for information service networks for providing information such as stock market news, weather forecasts and information for various exhibitions, it has been desired to use a speech synthesizer which can provide various information by speech. Some learning machines use the speech synthesizers to provide questions by speech.

One type of the speech synthesizer uses a record-and-edit method in which speech prerecorded on a recording tape is edited to produce a speech signal while the other type of the speech synthesizer uses a speech synthesizing method in which a voice waveform is not recorded but instead characteristic parameters of voice extracted from the voice signal are converted to digital signals and recorded and the speech is synthesized based on the recorded characteristic parameters. In order to synthesize the speech with a high quality in the record-and edit method, the unit of speech prerecorded must be no shorter than one word. Thus, when the number of words synthesized is to be increased, a huge capacity of memory unit is needed. Therefore, the number of words to be synthesized cannot be increased substantially. In the speech synthesizing method using the characteristic parameters of the speech, the unit of speech to be synthesized may be one syllable which is shorter than a word, a number of words can be synthesized without increasing the storage capacity of the memory unit.

Accordingly, it is desirable for the speech synthesizer to synthesize the speech based on the characteristic parameters of the speech because it can reduce the size of the memory unit.

The frequency components of the voice signal range from approximately 100 Hz to 10 kHz. The transmission of the speech sound is not significantly affected even if the frequency components ranging above 4 kHz are eliminated. Thus, the speech signal components ranging from 100 Hz to 4 kHz may be sampled at a sampling frequency of 8 kHz, for example, so that resulting time sequence represents the speech signal. In addition, since the changes in a speech spectrum are caused by the movement of sound controlling organs of human beings such as tongue and lips, the changes are gentle and they may be regarded substantially steady when observed in a short time period such as 3–10 milliseconds period. Thus, by exactly extracting the characteristics of the speech spectrum in the steady state period, the speech can be analyzed and it can also be synthesized based on the extracted information. When the speech is to be analyzed and synthesized, a parameter representing an envelope of the speech spectrum, a parameter representing the amplitude of the speech signal, pitch information corresponding to a fundamental oscillation frequency of a vocal chord and discrimination information for discriminating voiced sounds and unvoiced sounds may be extracted from the speech spectrum in the short time period in which the changes in the speech spectrum may be regarded steady. The envelope of the frequency spectrum of the speech signal corresponds to a transmission characteristic of a vocal tract and it includes vocal sound information, that is, information defining [a] sound, [o] sound and so on. Accordingly, the envelope of the frequency spectrum need be exactly extracted with less amount of information.

One of speech analyzing and synthesizing methods in which the characteristic parameters are extracted from the speech signal and the speech is synthesized based on the extracted parameters is a PARCOR type analyzing and synthesizing method which uses a partial auto-correlation coefficient (hereinafter referred to as a PARCOR coefficient) which is a kind of linear prediction coefficient. In this method, the characteristic parameters of the speech signal are represented by the PARCOR coefficients. The speech signal in a short time period in which the changes in the frequency spectrum of the speech signal are gentle and may be regarded steady are sampled at a sampling frequency of 8 kHz, for example, samples at two adjacent time points in the resulting sample sequence are predicted by a minimum square method using samples which exist between those two samples, the predicted value and the actual samples at those two time points are compared to determine differences therebetween, and correlations of the differences (PARCOR coefficients) are determined therefrom. The time difference between the two time points are then changed to the double, the triple and so on and the respective correlations are determined. Those are used as parameters representing the envelope of the frequency spectrum of the speech signal.

In the speech synthesizer, signal generators for generating white noise and pulses are used as a sound source (i.e., excitation source), an amplitude of an output signal of which is controlled by the PARCOR coefficients to impart the correlation to the output signal in order to reproduce the frequency spectrum envelope to synthesize the speech.

In the PARCOR type speech analyzing and synthesizing method, all of the PARCOR coefficients which are derived by analyzing the speech, the pitch information, the amplitude information and the discrimination information for the voiced sounds and the unvoiced sounds can be handled in the form of binary coded digital signal. Accordingly, those information can be stored in a semiconductor memory and they may be read out of the memory when they are necessary, to synthesize the speech. When the speech is synthesized, the PARCOR coefficients are used to impart the correlation to the sound source signal. The PARCOR coefficients are supplied to a digital filter to control the amplitude of the sound source signal depending on the coefficients. The digital filter may comprise approximately ten filters of the same structure connected in cascade with each stage of filter forming a lattice filter having two multipliers, two adder/subtractors and one delay line. The sound source signal is fed to the digital filter in which the PARCOR coefficients are multiplied to the signal.

In the PARCOR type speech analyzer/synthesizer, a PARCOR coefficient extractor may underestimate a bandwidth for the frequency spectrum of the speech signal. This underestimation for the bandwidth frequently occurs for female speech having a high pitch. This is because the speech spectrum comprises a fundamental frequency and harmonic components thereof, and the female speech includes a high fundamental frequency so that harmonization structure is coarse, which makes exact estimation of the spectrum difficult.

This underestimation for the bandwidth causes an extremely sharp peak on the spectrum envelope. Such underestimation of the bandwidth of the spectrum envelope causes the degradation of quality as shown below:

(1) Because of the extremely sharp peak on the estimated spectrum peak, the frequency components of the synthesized speech are concentrated and unnatural tone results.

(2) Since a spectrum sensitivity of the PARCOR coefficients is materially increased, a small quantization error in the PARCOR coefficients results in a large spectrum distortion. Accordingly, the quantization characteristic of the PARCOR coefficients is materially affected.

(3) Resonance of the pitch frequency in the synthesization and the peak characteristic is enhanced so that the amplitude of the synthesized speech increases abnormally. As a result, a large mismatching occurs between the input sound amplitude and the output sound amplitude in the analyzer/synthesizer.

As an approach for overcoming the problem of underestimation of the bandwidth, a method has been proposed in which a loss circuit is inserted in each stage of the lattice filter of the speech synthesizer to attenuate the amplitude of the peak in the estimated spectrum envelope so that the bandwidth of the peak of the spectrum envelope is widened. In this method, the bandwidth can be widened by 30–10 Hz when the sampling frequency is 8 kHz so that the degradation of quality of synthesized speech due to the underestimation of the bandwidth can be prevented. The loss circuit inserted in each stage of the filter may comprise a multiplication circuit which multiplies by the factor of any value between 0.988 and 0.998.

In this speech synthesizer, however, when a 10-stage digital filter is used, it includes 30 filter elements, 30 multipliers and 20 adder/subtractors, and when the sampling frequency is 8 kHz, the digital filter must carry out multiplication operation 20 times, addition/subtraction operation 20 times and multiplication operation in the loss circuits 10 times, within 125 microseconds.

In order to carry out the multiplication operations at least 30 times within 125 microseconds, each multiplication operation must be carried out within approximately four microseconds. The multiplication operation of 10 bits×15 bits in such a short time period needs a high speed multiplier which renders the speech synthesizer expensive. This causes a barrier for the popularization of the applied products of the speech synthesizers to home consumers. It is therefore desirable to provide the speech synthesizer of a simple construction.

It is an object of the present invention to provide a PARCOR type speech synthesizer which is simple in construction, inexpensive and suited for IC implementation.

According to the speech synthesizer of the present invention, a multiplier is of pipelined multiplier structure. Thus a product for a multiplication input for every unit time period (1/20 of a sampling period) is produced in every unit time period after a predetermined time delay so that operation speed of the multiplier is increased with apparent multiplication time being equal to one unit time period. Loss circuits multiplying a constant $\alpha$ to input signals are composed of subtraction circuits so that operation speed of the loss circuits is rendered in one unit time period. The sampling period is divided into 20 unit time periods so that 20 multiplication operations, 20 addition/subtraction operations and 10 subtraction operations in the loss circuits are carried out in the 20 unit time periods. With this arrangement, the addition/subtraction operation which is a basic operation need be carried out in 6.25 microseconds when the sampling frequency is 8 KHz, accordingly a high speed element is not required and the speech synthesizer can be constructed with inexpensive elements.

Figure 1:
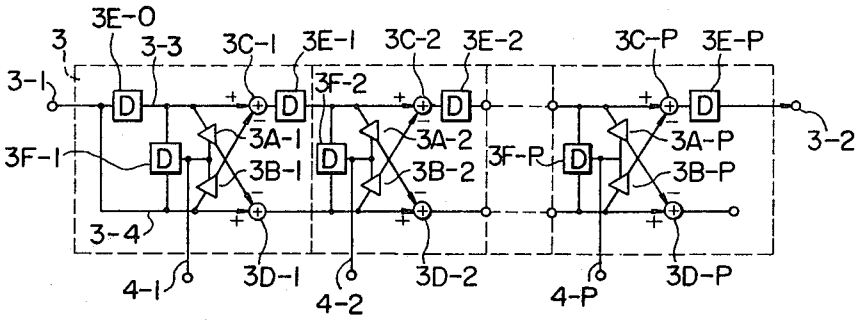
FIG. 1 PRIOR ART
FIG. 1 shows a circuit diagram of a prior art speech analyzer.

Before describing the speech synthesizer of the present invention, a speech analyzer for extracting PARCOR coefficients from a frequency spectrum of a speech signal is first explained. FIG. 1 shows a block diagram of a digital filter for extracting the PARCOR coefficients from the speech signal. The digital filter 3 comprises a P-stage cascade-connected lattice filters of the same construction. The first stage filter comprises two multipliers 3A-1, 3B-1, two subtractors 3C-1, 3D-1, a correlator 3F-1 and a delay line 3E-1, and the second stage filter comprises two multipliers 3A-2, 3B-2, two subtractors 3C-2, 3D-2, a correlator 3F-2 and a delay line 3E-2. Similarly, the third stage through the P-th stage filters each comprises two multipliers, two subtractors, a correlator and a delay line. Another delay line 3E-O is additionally provided only to the first stage filter. A signal channel of the filter 3 is divided into two sub-channels, one being a post-line prediction error channel 3-3 including the delay lines 3E-O to 3E-P and the other being a pre-line prediction error channel 3-4 including the subtractors 3D-1 to 3D-P. Both channels affect to each other through the lattice filters.

A signal applied to an input terminal 3-1 is a digital signal which is derived by sampling the speech signal at the sampling frequency of 8 KHz and converting the resulting sample sequence to the digital signal. In the first stage lattice filter, a correlation of the speech signal samples separated by one sample period is determined by the correlator 3F-1. The resulting correlation coefficient is used as a PARCOR coefficient ($k_1$) which is provided at an output terminal 4-1. This coefficient $k_1$ is multiplied with input signals to the multipliers 3A-1 and 3B-1 in the multipliers 3A-1 and 3B-1, respectively, and the correlation components are eliminated in the subtractors 3C-1 and 3D-1. The resulting signal is fed to the succeeding stage lattice filter.

In the second stage, a partial auto-correlation of the samples separated by two sampling periods, of the remaining correlation components which were not eliminated in the first stage is determined in the correlator 3F-2. The resulting correlation coefficient is used as a PARCOR coefficient ($k_2$) which is provided at an output terminal 4-2. Like in the first stage, the correlation components are eliminated by the coefficient $k_2$, the multipliers 3A-2 and 3B-2 and the subtractors 3C-2 and 3D-2, and the resulting signal is fed to the succeeding stage lattice filter. In this manner, the correlation components which were not eliminated in the preceeding stage are eliminated in the succeeding stage by determining the partial auto-correlation of the samples separated by one more sampling periods than in the previous stage and eliminating the correlation components by the resulting partial auto-correlation coefficient or PARCOR coefficient, and the resulting signal is fed to the succeeding stage.

When ten stages of lattice filters are used, the output signal from the tenth stage lattice filter is substantially non-correlated signal or so-called white noise and the spectrum envelope information of the speech signal in a short time period is included in the PARCOR coefficients $k_1$ to $k_{10}$. From the signal which remains after the PARCOR coefficients have been extracted by the lattice filters 3, pitch information of the speech signal, amplitude information and discrimination signal for voiced sounds and unvoiced sounds are further extracted. Those information together with the PARCOR coefficients are transmitted or stored.

Figure 2:
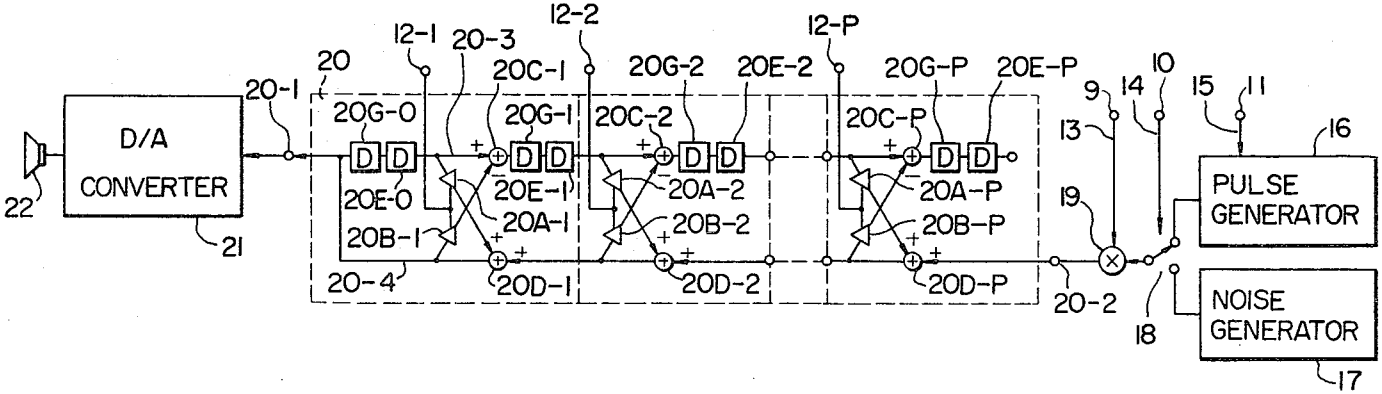
FIG. 2 shows a block diagram of a digital filter used in a speech synthesizer of the present invention.

Referring to FIG. 2, the speech synthesizer of the present invention which synthesizes the speech based on the PARCOR coefficients thus produced is now explained.

FIG. 2 shows a circuit diagram which makes easier the understanding of the digital filter used in the speech synthesizer of the present invention. The speech synthesizer comprises a pulse generator 16, a noise generator 17, a voiced/unvoiced sound selection switch 18, a multiplier 19 for controlling an amplitude of a sound (excitation) source, a spectrum envelope reproducer 20 and a digital-to-analog converter 21. The output signal from the sound source comprising the pulse generator 16, the noise generator 17, the selection switch 18 and the multiplier 19 is controlled by a voiced/unvoiced sound selection signal 14 derived by the speech analysis, a pitch information signal 15 and an amplitude information signal 13. Those information signals are applied to terminals 9, 10 and 11. For the voiced sound, the pulse generator 16 is selected by the switch 18 and for the unvoiced sound the noise generator 17 is selected. For the voiced sound, the pulse frequency of the pulse generator 16 is determined by the pitch information 15. The amplitude of the sound source signal to be applied to the spectrum envelope reproducer 20 is controlled by the multiplier 19 based on the amplitude information. The spectrum envelope reproducer 20 has a transfer characteristic which corresponds to a spectrum envelope defined by the PARCOR coefficient 12. The sound source signal is controlled by the transfer characteristic, thence it is converted to an analog signal by the digital-to-analog converter 21 and a speech signal is reproduced by a speaker 22.

The characteristic of the spectrum envelope reproducer 20 is reverse to the characteristic of the PARCOR coefficient extractor 3 described above. The spectrum envelope reproducer 20 comprises multipliers 20A-1 to 20A-P and 20B-1 to 20B-P, adder/subtractors 20C-1 to 20C-P and 20D-1 to 20D-P, delay lines 20E-0 to 20E-P and loss circuits 20G-0 to 20G-P. An input terminal 20-2 is connected to one input terminal of the tenth stage adder 20D-P and an output terminal is taken from a terminal 20-1. The first stage lattice filter comprises two multipliers 20A-1 and 20B-1, a subtractor 20C-1, an adder 20D-1, a delay line 20E-1 and a loss circuit 20G-1, and the second stage lattice filter comprises two multipliers 20A-2 and 20B-2, a subtractor 20C-2, an adder 20D-2, a delay line 20E-2 and a loss circuit 20G-2. Similarly, the third to tenth stage lattice filters each comprises two multipliers, a subtractor, an adder, a delay line and a loss circuit. The first stage filter further includes a loss circuit 20G-0 and a delay line 20E-0.

With this arrangement, the first PARCOR coefficient $k_1$ derived from the speech analyzer is fed to the first stage filter input terminal 12-1 and the second PARCOR coefficient $k_2$ is fed to the second stage filter input terminal 12-2. Similarly, the third to tenth PARCOR coefficients $k_3$ to $k_{10}$ are fed to the respective stage filter input terminals. The signal from the sound source 16 or 17 supplied to the input terminal 20-2 of the lattice filter 20 passes through one signal channel 20-3 including the adders 20D-1 to 20D-P of the filter 20 and the other signal channel 20-4 including the loss circuit 20G-0, the delay line 20E-0 and the subtractor 20C-1. In the tenth stage filter, the signal of the sound source is multiplied with the tenth PARCOR coefficient $k_{10}$ in the multipliers 20A-P and 20B-P and the resulting product is added to the sound source signal on the signal channel 20-4 by the adder 20D-P. The resulting product from the multiplier 20B-P is subtracted from the sound source signal on the signal channel 20-3 by the subtractor 20C-P. The PARCOR coefficients $k_9$ and $k_8$ are multiplied in the ninth and eighth stage filters, respectively, and so on, and the results are added to and subtracted from the sound source signal. In the first stage filter, the sound source signal to which the PARCOR coefficients have been multiplied in the tenth to second stage filters is multiplied by the first PARCOR coefficient $k_1$ in the two multipliers 20A-1 and 20B-1, and the resulting product from the multiplier 20A-1 is added to the signal on the signal channel 20-4 in the adder 20D-1 while the resulting product from the multiplier 20B-1 is subtracted from the signal on the signal channel 20-3 in the subtractor 20C-1. The output signal from the subtractor 20C-1 is attenuated in the loss circuit 20G-1, an output signal of which is fed to the delay line 20E-1. The output signal from the adder 20D-1 is fed to the output terminal 20-1, thence to the digital-to-analog converter 21 where it is converted to an analog signal.

In the speech synthesizer shown in FIG. 2, when the number P of the stages of the lattice filters is 10, the operation formulas for the ten lattice filters are given in Table 1 attached herein, where $y_1$ to $y_{10}$ are output signals of the adders 20D-1 to 20D-P. $B_2$ to $B_{11}$ are output signals of the subtractors 20C-1 to 20C-P, $b_1$ to $b_{11}$ are output signals of the loss circuits 20G-0 to 20G-P, $k_1$ to $k_{10}$ are PARCOR coefficients and time relations of the output signals are as shown in the Table 1, and y, B and b are shown in parentheses such as $y_1(i)$, $B_2(i)$ and $b_3(i-1)$.

Since the output $B_{11}$ of the tenth stage subtractor 20C-P and the output $b_{11}$ of the loss circuit 20G-P are not necessary in determining the output signal $y_1$ of the first stage lattice filter, they are not operated. The input signal to the lattice filter is the output signal of the pulse generator 16 or the noise generator 17 which is controlled by the power signal 13 which includes the amplitude information. That is, it is multiplied in the multiplier 19. The operation of the multiplier 19 is carried out at the operation timing for determining the output $B_{11}$ of the tenth stage subtractor 20C-P.

Figure 3:
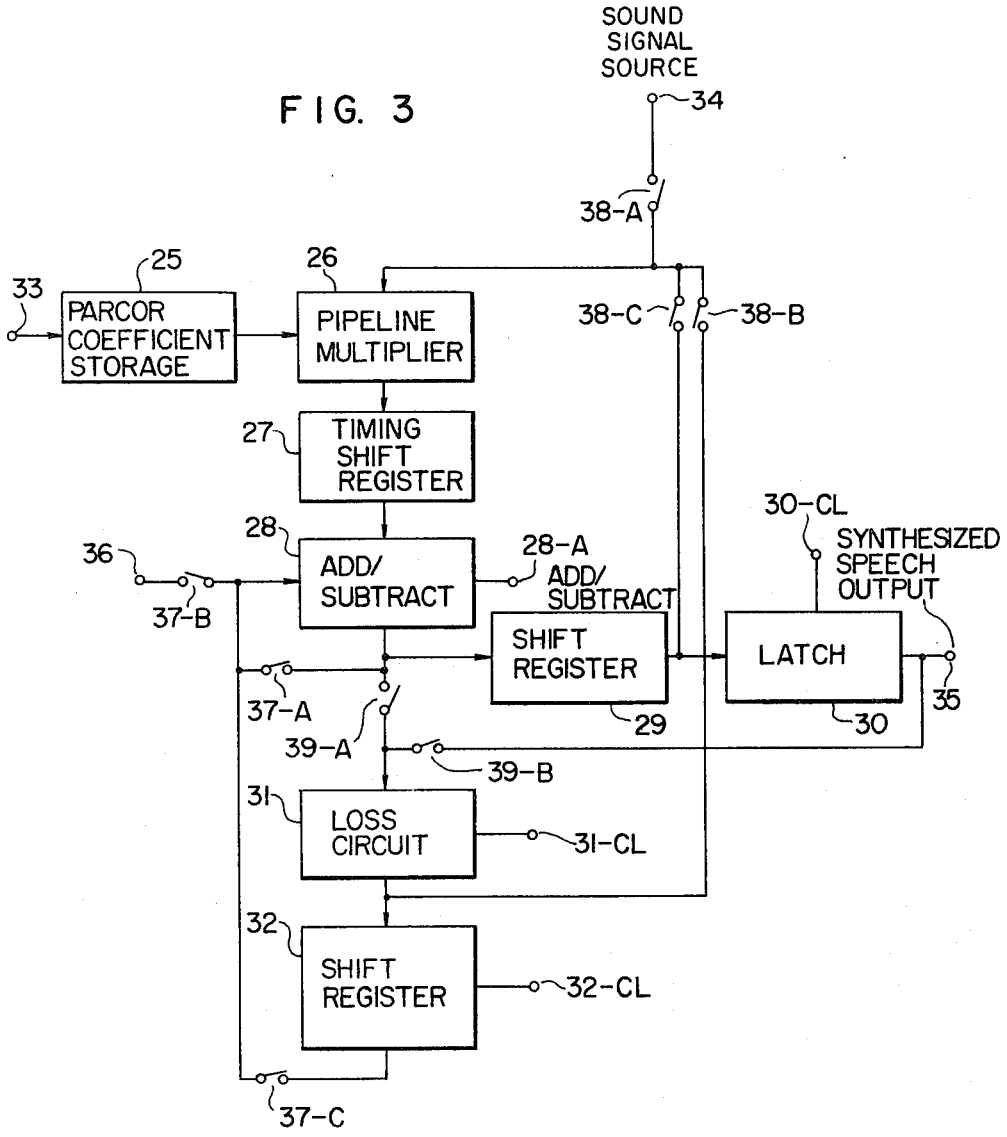
FIG. 3 shows a block diagram of the digital filter of the present invention.

FIG. 3 shows a circuit diagram of the digital filter of the speech synthesizer of the present invention, in which the digital filter shown in FIG. 2 is implemented by a pipelined multiplier. In FIG. 3, numeral 26 denotes a pipelined multiplier, 25 a PARCOR coefficient storage, 27 a timing shift register, 28 an adder/subtractor, 28-A an add/subtract control terminal, 29 a shift register, 30 a latch circuit, 31 a loss circuit, 32 a shift register which serves as a delay element of the lattice filter, 34 a drive sound source input terminal, 35 a synthesized speech output terminal, and 37, 38 and 39 switches for switching the flows of signals.

Each block operates in a unit time period and reads in input data at a clock $\phi_1$ and produces an output at a clock $\phi_2$. Numerals 31-CL and 32-CL denote terminals for controlling the read-in of the input data, i.e. the application of the clock $\phi_1$.

This arrangement carries out the operations of the ten stages of lattice filters by one pipelined multiplier, one adder/subtractor and one subtractor of the loss circuit and associated circuits when 20 times of multiplication operations, 20 times of add/subtract operations and 10 times of subtract operations in the loss circuit are properly timed. The operation and timing thereof of the arrangement are now explained with reference to an operation timing chart shown in FIG. 4, a switching mode diagram shown in FIG. 5 and operation process charts shown in Tables 2 and 3 attached herein. The operations of the respective blocks will be explained hereinlater.

Figure 4:
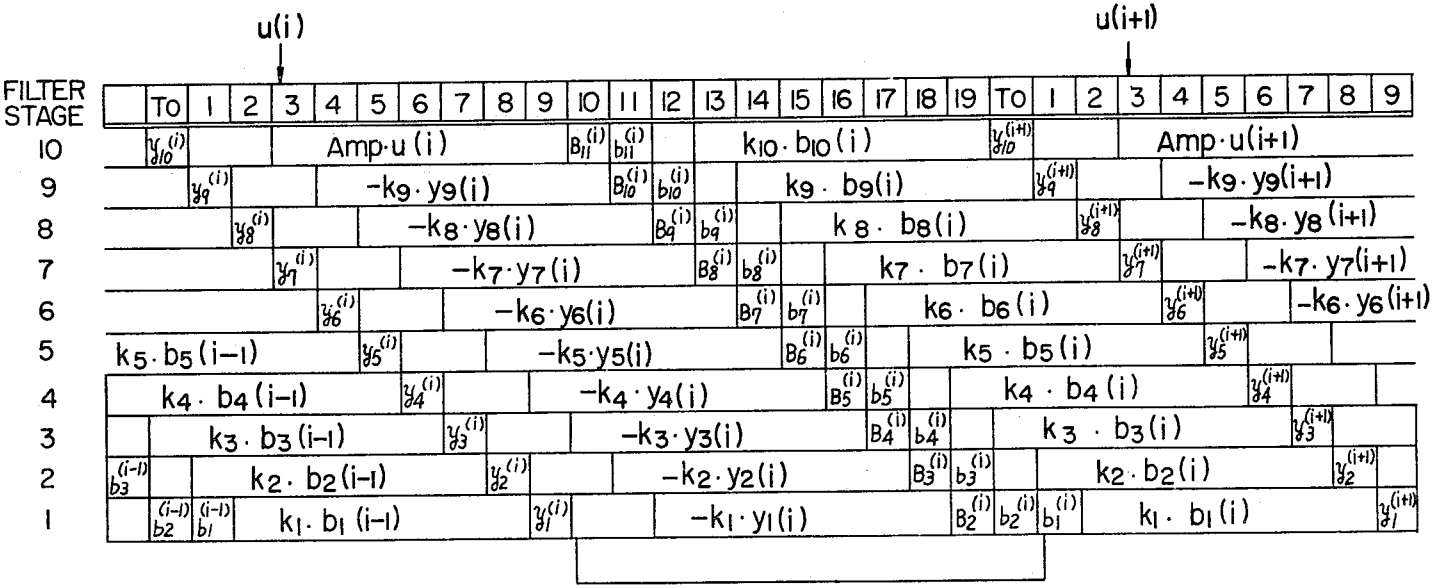
FIG. 4 shows an operation timing chart of the digital filter of the present invention.

The unit time periods are represented by $T_0$ to $T_{19}$. During the time periods $T_0$ to $T_{19}$ the operations of the ten stages of filters are carried out. The operation timing for the i-th cycle and the (i+1)th cycle of the sampling cycles is shown in FIG. 4. In the time period $T_0$, the operation of the tenth stage filter of the filter shown in FIG. 2 is carried out. The output of the multiplier previously calculated, that is, the output of the shift register 27 shown in FIG. 3 is fed to the adder 28, and the result of the operation by the power signal Amp which includes the amplitude information and the drive signal $u(i-1)$, carried out in the $(i-1)$th cycle is also supplied to the adder 28 from the output of the shift register 32 through the switch 37-C. The resulting sum, i.e. the output signal $y_{10}(i)$ is used as one input signal for the addition operation for determining the output signal $y_9(i)$ in the time period $T_1$. The output signal $y_{10}(i)$ of the adder 28 is fed to one input of the adder 28 through the switch 37-A and the output signal $y_9(i)$ is produced at the output of the adder 28. In this manner, the adder output signal $y_j(i)$ of the j-th stage filter is used as one input signal for determining the adder output signal $y_{j-1}(i)$ of the $(j-1)$th stage filter while the other input signal is derived from the product signal $k_{j-1}\cdot b_{j-1}(i-1)$. In this manner, the output signal $y_1(i)$ of the lattice filter is produced and it is supplied through the shift register 29 to the latch circuit 30 where it is latched until the next output signal $y_1(i+1)$ is produced.

The procedures (and timing) for determining the adder output signal $y_1(i)$ has been explained. Before it is determined, the output signal $b_j(i-1)$ of the loss circuit and the product of the output signal of the loss circuit and the PARCOR coefficient have to be determined. In the above explanation, it was assumed that the output signal $b_j(i-1)$ of the loss circuit and the product of that output signal and the PARCOR coefficient $k_j\cdot b_j(i-1)$ had been produced. Now, the operation timing for determining the output signals $b_j(i)$ and $k_j\cdot b_j(i)$ and the output signal $B_j(i)$ of the subtractor, which are necessary to determine $y_1(i+1)$ is explained. In order to determine the output signals $y_1(i+1)$ and $y_2(i+1)$, the output signals $y_2(i+1)$ and $y_3(i+1)$, respectively, must have been determined. Thus, starting from $y_{10}(i+1)$, the lower order $y_j(i+1)$ signals are sequentially determined and $y_1(i+1)$ is finally determined. In order to determine those $y_j(i+1)$ signals, one input signal to the adder 20D-j of the j-th stage filter shown in FIG. 2, that is, the multiplier output signal $k_j\cdot b_j(i)$ must have been determined. Further, in order to determine the output signal $k_j\cdot b_j(i)$, the output signal $b_j(i)$ of the j-th stage loss circuit must have been determined, and in order to determine the output signal $b_j(i)$, the output signal $B_j(i)$ of the j-th stage subtractor must have been determined. The output signal $B_j(i)$ is the product of the output signal $y_j(i)$ and the PARCOR coefficient $k_j$. Thus, the output signals $y_j(i)$ (where j=9 to 1) are sequentially applied to the input of the pipelined multiplier 26 through the timing shift register 29 and the switch 38-C. On the other hand, the PARCOR coefficients $k_j$(where j=9 to 1) are applied to the other input of the pipelined multiplier 26 from the PARCOR coefficient storage 25 in correspondence to the order j of the output signal $y_j(i)$.

As a result, the multiplication of $k_j\cdot y_j(i)$ starts for each of the unit time periods $T_4$ to $T_{12}$ and the products are delayed by seven unit time periods through the shift register 27 and then sequentially outputted in the order of j (=9 to 1) in every unit time period. The products are then sequentially applied to one subtractor input of the adder/subtractor 28 by the add/subtract control signal 28-A in the next unit time period while the signals $b_j(i-1)$ are applied to the other input of the adder/subtractor 28 from the shift register 32 through the switch 37-C. In this manner, the signals $B_{j+1}(i)=b_j(i-1)$ to $k_j\cdot y_1(i)$ (where j=9 to 1) are sequentially obtained in each of the unit time periods $T_{11}$ to $T_{19}$.

As explained above, since the operations of $y_{10}(i)\cdot k_{10}$ and $B_{11}(i)=b_{10}(i-1)-y_{10}(i)\cdot k_{10}$ are not necessary, the drive sound source signal u(i) applied to the input terminal 34 through the switch 38-A and the power signal Amp from the PARCOR coefficient storage 25 are applied to the pipelined multiplier 26 in the unit time period $T_3$. The resulting product Amp·u(i) is delayed by seven unit time periods and in the time period $T_{10}$ it is added in the adder/subtractor 28 to the zero signal applied to the input terminal 36 through the switch 37-B by the control signal 28-A. As a result, the output signal $B_{11}(i)$ is applied to the loss circuit 31 through the switch 39-A and the resulting signal $b_{11}(i)$ is applied to the shift register 32. This signal is retained in the shift register 32 until it is applied to one input of the adder/subtractor 28 to produce the signal $y_{10}(i+1)$ in the next time period $T_0$.

The signals $B_{10}(i)$ to $B_2(i)$ thus produced are sequentially applied to the loss circuit 31 through the switch 39-A in each of the unit time periods, and after one unit time delay the loss circuit output signals $b_{10}(i)$ to $b_2(i)$ are sequentially produced in each of the unit time period. In the next time period after the output signal $b_2(i)$ is produced, the output signal $y_1(i)$ of the latch circuit 30 is applied to the input of the loss circuit 31 through the switch 39-B, and after one unit time delay, the loss circuit 31 produces the output signal $b_1(i)$. In this manner, in every unit time period the loss circuit 31 sequentially produces the output signals $b_{10}(i)$ to $b_1(i)$, which are sequentially applied to one input of the pipelined adder 26 through the switch 38-B. On the other hand, the signals $b_9(i)$ to $b_1(i)$ are applied to the shift register 32 where they are stored for use in producing the signals $B_{10}(i+1)$ to $B_2(i+1)$ in the next sampling cycle.

On the other hand, the PARCOR coefficients $k_j$ are sequentially applied to the other input of the pipelined multiplier 26 from the PARCOR coefficient storage 25 in correspondence of the order j of the signals $b_j(i)$ (where j=10 to 1) so that the products $k_j \cdot b_j(i)$ (where j=10 to 1) are sequentially calculated. The products are produced in every unit time period after seven unit time delay including the delay in the shift register 27. As a result, the output signals $y_{10}(i+1)$ to $y_1(i+1)$ are produced in the unit time periods $T_0$ to $T_9$, and the output signal $y_1(i+1)$ is applied to the latch circuit 30 through the shift register 29 and latched therein by a latch data read signal supplied from the terminal 30-CL. It is latched until the next output signal $y_1(i+2)$ is produced.

Figure 5:
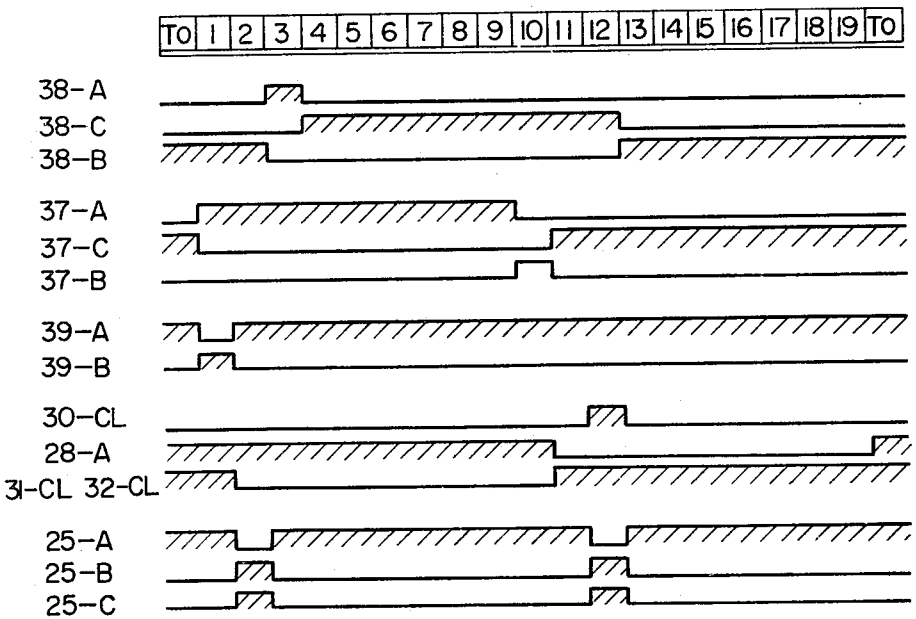
FIG. 5 shows a timing chart of operation modes of switches in the circuit shown in FIG. 3.

In order to properly time the operations described above, the operation timing of the switches 37, 38 and 39 which control the signal flows and the timing of the control signals for reading the input signals to the loss circuit and the shift register 32, that is, the control signals supplied to the terminals 31-CL and 32-CL for controlling the shift operations for each unit time period and the control signal supplied to the terminal 30-CL for controlling the read-in of the input signal to the latch circuit 30 are important. The operation timing for those operations is shown in FIG. 5. For the switches 37, 38 and 39, they are on in the hatched time periods and off in other time period. The switches 37 serve to select one input signal to the adder/subtractor 28 and they select the zero value at the terminal 36, the output signal of the adder/subtractor 28 or the output signal of the shift register 32. Either one of the switches 37-A, 37-B and 37-C is on at any time. The switches 38 function to select the input signal to the pipelined multiplier 26 and they select the drive sound source signal u supplied to the terminal 34, the output signal of the loss circuit 31 or the output signal of the shift register 29. Either one of the switches 38-A, 38-B and 38-C is on at any time. The switches 39 function to select the input signal to the loss circuit 31 and they select the output signal of the adder/subtractor 28 or the output signal of the latch circuit 30. Either one of the switches 39-A and 39-B is on at any time.

The signals applied to the respective input terminals through those switches are now explained with the comparison of the operation procedures of the respective blocks in the respective time periods shown in the Tables 2 and 3. The switch 38-A is turned on in the time period $T_3$ so that the sound source signal u(i) is applied to one input terminal of the pipelined multiplier 26. The switch 38-C is turned on in the time periods $T_4$ to $T_{12}$ so that the output signals $y_9(i)$ to $y_1(i)$ of the shift register 29 are sequentially applied to the one input terminal of the pipelined multiplier 26 in every unit time period. The switch 38-B is turned on in the time periods $T_{13}$ to $T_{19}$ and $T_0$ to $T_2$ so that the output signals $b_{10}(i)$ to $b_1(i)$ of the loss circuit 31 are sequentially applied to the one input terminal of the pipelined multiplier 26 in every unit time period. Applied to the other input terminal of the pipelined multiplier 26 are the PARCOR coefficients $k_j$ from the PARCOR coefficient storage 25 in correspondence the order j of the signal $y_j(i) \cdot b_j(i)$ in every unit time period, and the power signals Amp are sequentially applied to the sound source signal u(i). The switch 37-A is turned on in the time periods $T_1$ to $T_9$ so that the output signals $y_{10}(i)$ to $y_2(i)$ of the adder/subtractor 28 are sequentially applied to one input terminal of the adder/subtractor 28 in every time period. The switch 37-B is turned on in the time period $T_{10}$ so that zero value at the input terminal 36 is applied to the one input terminal of the adder/subtractor 28. The switch 37-C is turned on in the time periods $T_{11}$ to $T_{19}$ and $T_0$ so that the output signals $b_9(i-1)$ to $b_1(i-1)$ and $b_{11}(i) = \text{Amp} \cdot u(i) \cdot \alpha$ of the shift register 32 are sequentially applied to the one input terminal of the adder/subtractor 28 in every time period. Applied to the other input terminal of the adder/subtractor 28 are the products of the pipelined multiplieer 26 through the shift register 27 so that the following operations are carried out:

$$b_{11}(i-1)+k_{10} \cdot b_{10}(i-1) \quad (1)$$

$$y_{j+1}(i)+k_j \cdot b_j(i-1), \text{ where } j=9 \text{ to } 1 \quad (2)$$

$$0+\text{Amp} \cdot u(i) \quad (3)$$

$$b_j(i-1)-k_j \cdot y_j(i), \text{ where } j=9 \text{ to } 1 \quad (4)$$

After one unit time delay, the results of the operations, $y_{10}(i)$ to $y_1(i)$, $B_{11}(i)$ and $B_{10}(i)$ to $B_2(i)$ are sequentially produced. The add/subtract control signal 28-A controls the adder/subtractor 28 in the subtraction mode in the time periods $T_{11}$ to $T_{19}$ in which the adder/subtractor 28 carries out the operation of $b_j(i-1)-k_j \cdot y_j(i)$, where j=9 to 1. The switch 39-B is on only during the time period $T_1$ so that the output signal $y_1(i-1)$ of the latch circuit 30 is applied to the loss circuit 31. The switch 39-A is on in the time periods other than the time period $T_1$ so that the output signals $B_2(i-1)$, $y_9(i)$ to $y_1(i)$, $B_{11}(i)$ and $B_{10}(i)$ to $B_2(i)$ of the adder/subtractor 28 are applied to the loss circuit 31. The output signal of the loss circuit 31 is applied to the shift register 32. The read-in of the input signals to the loss circuit 31 and the shift register 32, that is, shifting of the signals in every unit time period is controlled by the control signals applied at the terminals 31-CL and 32-CL. In the time periods $T_2$ to $T_{10}$, the loss circuit 31 and the shift register 32 do not read in the input signals under the control of the control signals and stop the shifting operation so that current data are stored therein. The output signals of the loss circuit 31, that is, $b_1(i-1)=\alpha \cdot y_1(i-1)$, $b_{11}(i) = \alpha \cdot B_{11}(i) = \alpha \cdot \text{Amp} \cdot u(i)$ and $b_{10}(i)=\alpha \cdot B_{10}(i)$ to $b_2(i)=\alpha \cdot B_2(i)$ are applied to the one input terminal of the adder/subtractor 28 through the shift register 32 and the switch 37-C.

The constructions and the operations of the respective blocks are now explained. Firstly, the pipelined multiplier is explained. It is a well-known multiplier and hence explained briefly.

Figure 6:
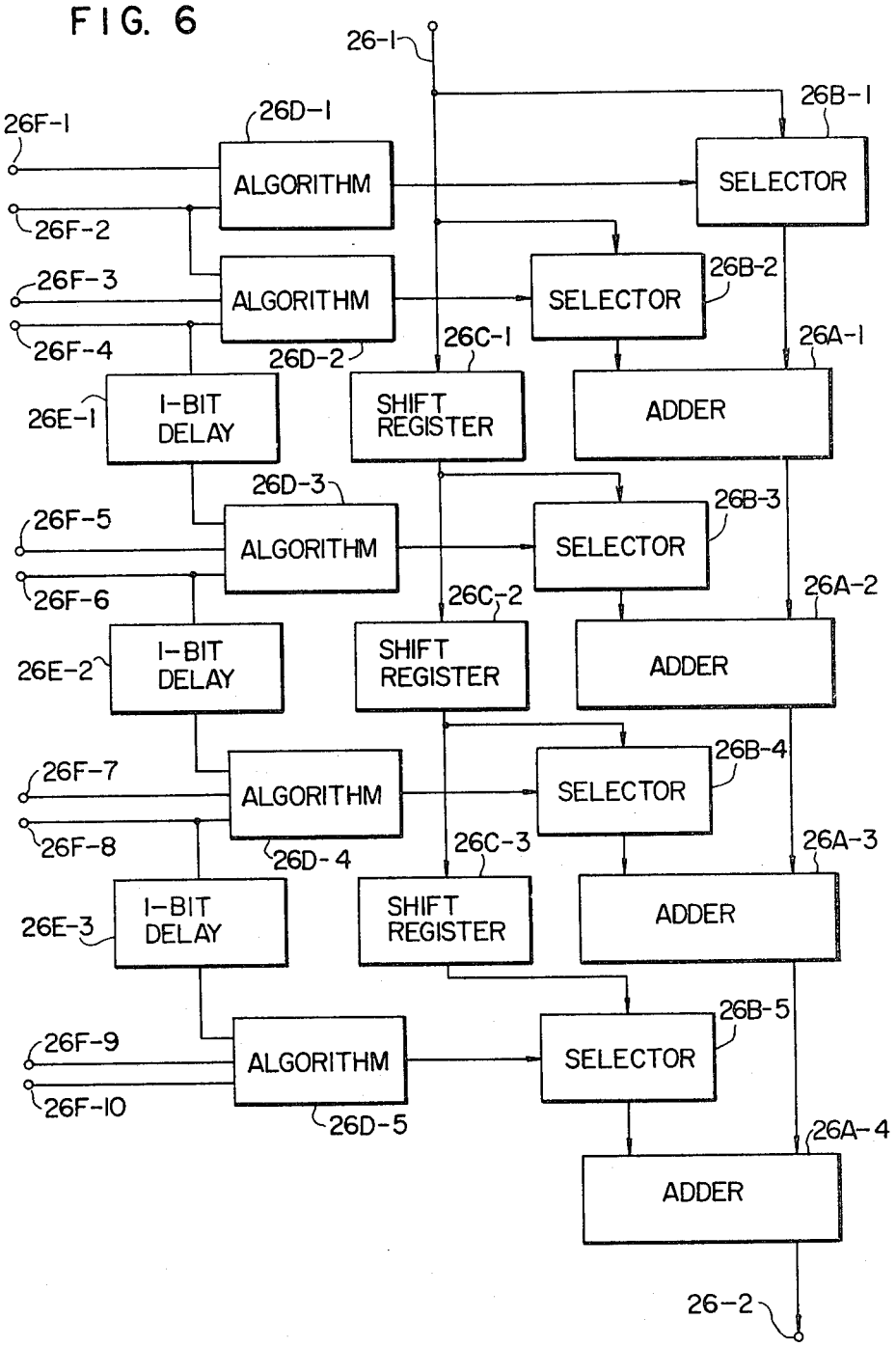
FIG. 6 shows a block diagram of a pipelined multiplier.

FIG. 6 shows the construction of the pipelined multiplier. Numeral 26-1 denotes a multiplicand input terminal, 26 a multiplier input terminal, 26C shift registers, 26B selectors for producing partial products corresponding to multipliers, 26A adders, 26D algorithm circuits for selecting one of multiplicands 0, ±1 or ±2 depending on the condition of three consecutive bits of the multiplier, 26E one-bit delay line, and 26-2 a multiplier output terminal. Since the multiplicands of the pipelined multiplier, i.e. the signals in the respective stages of the lattice filters are of 15-bits and the multiplies i.e. the PARCOR coefficients $k_{10}$ to $k_1$ and the power signal Amp are of 10 bits, the pipelined multiplier produces five partial products by two-bit algorithm and adds those partial products. Those operations are carried out in a pipelined fashion. The shift registers 26C, the one-bit delay lines 26E and the adders 26A operate in a unit time period such that they read in the input signals at a clock $\phi_1$ and produce the output signals at a clock $\phi_2$. As an example, the operation of the multiplier is explained for the operation procedures for the multiplicand u(i) and the multiplier Amp applied in the time period $T_3$. The multiplier signal Amp is represented by $B_1, B_2, \ldots B_{10}$ with $B_1$ being the least significant bit (LSB). In the time period $T_3$, the signal u(i) is applied to the input terminal 26-1 and the bits $B_1$ to $B_4$ are applied to the input terminals 26F-1 to 26F-4. The algorithm circuits 26D-1 and 26D-2 determine either one of 0, $\pm 1$ or $\pm 2$ weighted partical products 1 and 2. Th algorithm circuits 26D-1 and 26D-2 control the selectors 26B-1 and 26B-2 such that the output partial products 1 and 2 of the selectors 26B-1 and 26B-2 are produced depending on the input signal u(i) at the terminal 26-1. The selector 26B produces zero output when the output of the algorithm circuit 26D is "0", produces the selector input signal itself when the output of the algorithm circuit 26D is "1", a complement of the selector input signal when the latter is "−1", a one-bit left-shifted signal of the selector input signal when the latter is "2", and a complement of one-bit left-shifted signal of the selector input signal when the latter is "−2".

The process for adding one to the LSB of the selector output signal when the algorithm circuit output is "−1" or "−2" for the purpose of two's complement is carried out in the succeeding stage adder. In this manner, in the time period $T_3$, the partial products 1 and 2 from the selectors 26B-1 and 26B-2 are applied to the adder 26A-1, and in the time period $T_4$ the sum of the partial products 1 and 2 is produced and it is applied to the succeeding stage adder 26A-2. In the time period $T_4$, the shift register 26C-1 produces the output signal u(i) and the signals $B_5$ and $B_6$ are applied to the input terminals 26F-5 and 26F-6. Similarly, the selector 26B-3 is controlled by the output signal of the algorithm circuit 26D-3 to produce a partial product 3, which is applied to one input terminal of the adder 26A-2. The sum of the adder 26A-2, that is, the sum of the partial products 1, 2 and 3 is produced in the time period $T_5$. Similarly, in the time period $T_5$, the signals $B_7$ and $B_8$ are applied to the input terminals 26F-7 and 26F-8 to produce a partial product 4 and the adder 26A-3 produces a sum of the partial products 1, 2, 3 and 4 in the time period $T_6$. In the time period $T_6$, the signals $B_9$ and $B_{10}$ are applied to the input terminals 2F-9 and 2F-10 to produce a partial product 5 and the adder 26A-4 produces a sum of the partial products 1, 2, 3, 4 and 5, that is, the product of the signals Amp and u(i) is produced in the time period $T_7$. Thus, the output signals for the multiplication input are produced through four unit time periods and the signal $B_{11}(i)=\text{Amp}\cdot u(i)$ is applied to the one input terminal of the adder/subtractor 28 through the shift register 27 in the time period $T_{10}$.

It should be understood that in the addition of the partial products in the multiplier the partial products are left-shifted by two bit positions for digit registration. The output signal of the multiplier has 15 bits. Since the accumulated sum of the partial products of the sets of multiplicand and multiplier is propagated through the adders 26A-1 to 26A-4 in every unit time period, the products can be sequentially produced in every unit time period with four-unit time delay when the sets of multiplicands and multipliers are sequentially applied in every unit time period.

The PARCOR coefficient storage which supplies the multipliers, that is, the PARCOR coefficients $K_{10} \sim k_1$ and the power signal Amp to the pipelined multiplier is now explained. As explained above, four bits, i.e. the LSB to the fourth bit of the multiplier for the multiplier are to be applied to the terminals 26F-1 to 26F-4 in the first unit time period, two bits, i.e. the fifth and sixth bits as counted from the LSB are to be applied to the terminals 26F-5 and 26F-6 in the second unit time period, two bits, i.e. the seventh and eighth bits as counted from the LSB are to be applied to the terminals 26F-7 and 26F-8 in the third unit time period, and two bits, i.e. the ninth bit as counted from the LSB and the most significant bit (MSB) are to be applied to the terminals 26F-9 and 26F-10 in the fourth unit time period. Those multiplier bits may be sequentially supplied in a manner as shown in Table 4.

Figure 7:
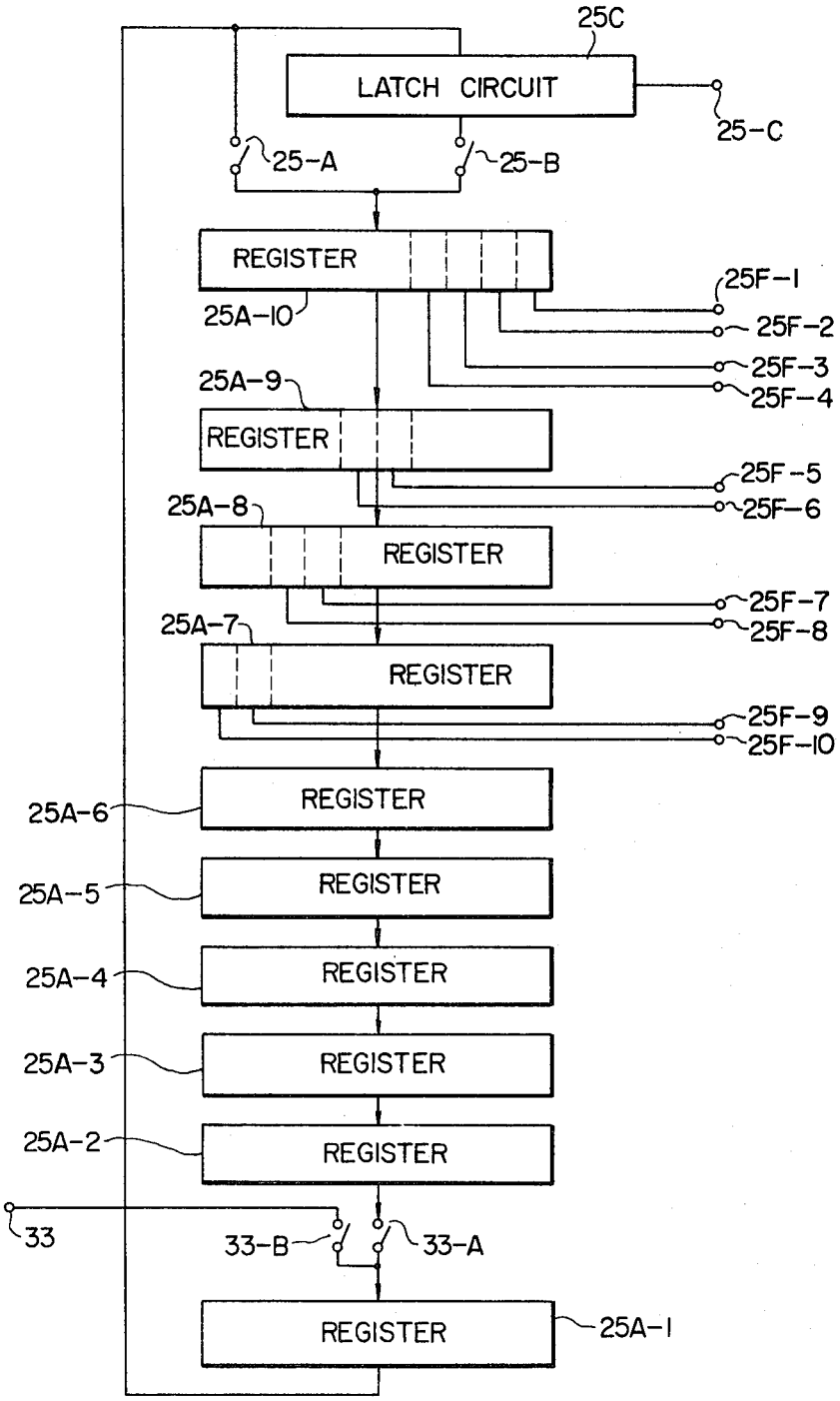
FIG. 7 shows a block diagram of a PARCOR coefficient memory unit.

FIG. 7 shows the construction of the PARCOR coefficient storage. It comprises a cyclic shift register configuration having ten stages of 10-bit registers and one stage of 10-bit latch circuit. It stores eleven parameters including the PARCOR coefficients $k_{10}$ to $k_1$ and the power signal Amp and provides those parameters as multipliers at the timing shown in Table 4 in synchronism with the timing of the multiplicand of the pipelined multiplier. Four bits, i.e. the LSB to the fourth bit, of the register 25A-10 are provided at the output terminals 25F-1 to 25F-4, two bits, i.e. the fifth and sixth bits as counted from the LSB, of the register 25A-9 are provided at the output terminals 25F-5 and 25F-6, two bits, i.e. the seventh and eighth bits as counted from the LSB, of the register 25A-8 are provided at the output terminals 25F-7 and 25F-8, and two bits, i.e. the ninth bit as counted from the LSB and the MSB, of the register 25A-7 are provided at the output terminals 25F-9 and 25F-10. Those output terminals 25F are connected to the multiplier input terminals 26F of the pipeline multiplier.

The signal flow within the PARCOR coefficient storage is shown by arrows in FIG. 7. As shown in Table 4, the parameters are outputted in the order of $k_{10}$ to $k_1$, Amp, $k_9$ to $k_1$ and again $k_{10}$ to $k_1$, Amp, $k_9$ to $k_1$. Accordingly it is necessary to alternately select the power signal Amp and the PARCOR coefficient $k_{10}$ for every ten unit time periods. This is carried out by the latch circuit 25C, a latch read-in signal applied to the terminal 25-C and the switches 25-A and 25-B. The timing of this operation is shown at the bottom of FIG. 5. New values of the parameters are read in through the switch 33-B and normally they are circulated through the switch 33-A.

Figure 8:
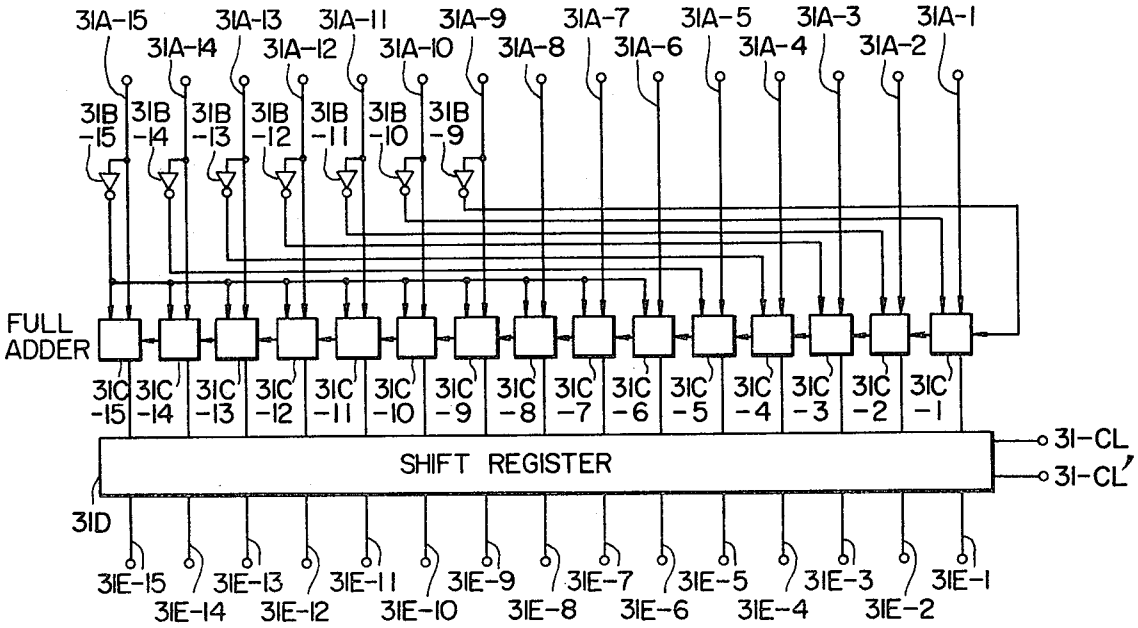
FIG. 8 shows a block diagram of a loss circuit.

The construction of the loss circuit which prevents the degradation of the quality of the synthesized speech due to the underestimation of the bandwidth of the spectrum envelope in the speech analyzer is now explained. The function of the loss circuit (20G in FIG. 2) is to multiply a constant $\alpha$ ($\alpha<1$) to the output signals of the subtractors 20C of the respective stages of lattice filters. In the present embodiment, $\alpha$ is set to 0.998, which can be expressed by $(2^9-1)/2^9$. Thus, the multiplication function can be expressed by:

$$\begin{aligned} L \cdot L_{in} &= L_{in} - L_{in}/2^9 \\ &= (1 - \tfrac{1}{2}^9)L_{in} \end{aligned}$$

where $L_{in}$ is the input signal to the loss circuit. Accordingly, the multiplication function can be carried out by subtracting the 9-bit right-shifted signal of the input signal $L_{in}$ to the loss circuit from the input signal $L_{in}$. This operation can be carried out in one unit time period like the addition/subtraction operations described above. The construction of the loss circuit is shown in FIG. 8, in which numeral 31A denotes 15-bit input terminals of the loss circuit, 31B inverters, 31C full adders, 31D a one-stage 15-bit shift register for controlling the unit time step operation, 31-CL a clock signal (which is synchronized with clock $\phi_1$) input terminal for reading in an input signal to the shift register 31D, 31-CL' a clock signal (which corresponds to clock $\phi_2$) input terminal for reading out internal data of the shift register 31D, and 31E 15-bit output terminals of the loss circuit. All signals in the present speech synthesizer are handled in the form of 2's complement.

The operation is now explained. The input signals of the loss circuit applied to the input terminals 31-A are applied to first input terminals of the full adders 31C. The bits of the input signals applied to the input terminals 31A-10 to 31A-14 are supplied to the inverters 31B-10 to 31B-14, respectively, thence to second input terminals of the full adders 31C-2 to 31C-5, respectively, which are 9-bit position shifted rightward, respectively. The signal bit applied to the input terminal 31A-15 is a sign bit of the input signal and it is supplied to the second input terminals of the full adders 31C-6 to 31C-15. The signal bit applied to the input terminal 31A-9 is supplied to the inverter 31B-9, thence to a carry input terminal of the full adder 31C-1. The inverted version of the signal applied to the input terminal 31A-9 is applied to the carry input terminal of the full adder 31C-1 in order to count as one fractions of more than 0.5 inclusive and cut away the rest for the operation result of the loss circuit. Carry outputs of the full adders 31C are connected to carry inputs of the next higher order full adders. Thus, sum outputs of the full adders 31C provide a 15-bit sum of $L_{in}+(-L_{in}/2^9)$ with the fractions of more than 0.5 being counted as one and the rest being cut away. This sum is provided through the 15-bit one-stage shift register 31D. Since the input signals to the loss circuit are applied in synchronism with the clock $\phi_2$ applied to the input terminal 31-CL', the output signal of the loss circuit is produced in one unit time period (which is a repetition period of the clock $\phi_2$).

In the prior art, in order to construct the speech synthesizer having ten stages of lattice filters each including the loss circuit for multiplying the constant $\alpha(\alpha<1)$, 20 times of multiplication operation (15 bits$\times$10 bits), 20 times of addition/subtraction operation (15 bits$\pm$15 bits) and the loss operations are needed in one sampling period. On the other hand, according to the present invention, the construction simply comprises one pipelined multiplier, adder/subtractors, subtractors of the loss circuit, shift registers and switches, and the pipelined multiplier comprises four stages of adders. All elements are constructed by the adder/subtractors and shift registers which are operated in one unit time period which is one-twentyth of the sampling period. Thus, when the sampling frequency is 8 KHz, the unit time period is 6.25 microseconds, which is slower than the slowest operation speed of the currently established MOS IC technology and within the ability of the inexpensive p-channel MOS IC technology. Accordingly, the speech synthesizer can be manufactured with a very low cost without requiring expensive and high speed IC process.

TABLE 1

| Filter stage | TERM $y_n(i)$ | TERM $B_n(i)$ | TERM $b_n(i)$ |
|---|---|---|---|
| 10 | $y_{10}(i)=b_{11}(i-1)+k_{10}.b_{10}(i-1)$ | $B_{11}(i)=0+A.u(i)$ | $b_{11}(i)=\alpha.B_{11}(i)$ |
| 9 | $y_9(i)=y_{10}(i)+k_9.b_9(i-1)$ | $B_{10}(i)=b_9(i-1)-k_9.y_9(i)$ | $b_{10}(i)=\alpha.B_{10}(i)$ |
| 8 | $y_8(i)=y_9(i)+k_8.b_8(i-1)$ | $B_9(i)=b_8(i-1)-k_8.y_8(i)$ | $b_9(i)=\alpha.B_9(i)$ |
| 7 | $y_7(i)=y_8(i)+k_7.b_7(i-1)$ | $B_8(i)=b_7(i-1)-k_7.y_7(i)$ | $b_8(i)=\alpha.B_8(i)$ |
| 6 | $y_6(i)=y_7(i)+k_6.b_6(i-1)$ | $B_7(i)=b_6(i-1)-k_6.y_6(i)$ | $b_7(i)=\alpha.B_7(i)$ |
| 5 | $y_5(i)=y_6(i)+k_5.b_5(i-1)$ | $B_6(i)=b_5(i-1)-k_5.y_5(i)$ | $b_6(i)=\alpha.B_6(i)$ |
| 4 | $y_4(i)=y_5(i)+k_4.b_4(i-1)$ | $B_5(i)=b_4(i-1)-k_4.y_4(i)$ | $b_5(i)=\alpha.B_5(i)$ |
| 3 | $y_3(i)=y_4(i)+k_3.b_3(i-1)$ | $B_4(i)=b_3(i-1)-k_3.y_3(i)$ | $b_4(i)=\alpha.B_4(i)$ |
| 2 | $y_2(i)=y_3(i)+k_2.b_2(i-1)$ | $B_3(i)=b_2(i-1)-k_2.y_2(i)$ | $b_3(i)=\alpha.B_3(i)$ |
| 1 | $y_1(i)=y_2(i)+k_1.b_1(i-1)$ | $B_2(i)=b_1(i-1)-k_1.y_1(i)$ | $b_2(i)=\alpha.B_2(i)$ |
| | | $B_1(i)=y_1(i)$ | $b_1(i)=\alpha.B_1(i)$ |

TABLE 2

| Time period | Multiplier input: From k-Stack | Multiplier input: From Bus Line | Multiplier output (one input to adder) | One input to adder | Adder output |
|---|---|---|---|---|---|
| $T_0$ | $k_3$ | $b_3(i-1)$ | $k_{10}.b_{10}(i-1)$ | $b_{11}(i-1)$ | $B_2(i-1)$ |
| $T_1$ | $k_2$ | $b_2(i-1)$ | $k_9.b_9(i-1)$ | $y_{10}(i)$ | $y_{10}(i)$ |
| $T_2$ | $k_1$ | $b_1(i-1)$ | $k_8.b_8(i-1)$ | $y_9(i)$ | $y_9(i)$ |
| $T_3$ | A | $u(i)$ | $k_7.b_7(i-1)$ | $y_8(i)$ | $y_8(i)$ |
| $T_4$ | $-k_9$ | $y_9(i)$ | $k_6.b_6(i-1)$ | $y_7(i)$ | $y_7(i)$ |
| $T_5$ | $-k_8$ | $y_8(i)$ | $k_5.b_5(i-1)$ | $y_6(i)$ | $y_6(i)$ |
| $T_6$ | $-k_7$ | $y_7(i)$ | $k_4.b_4(i-1)$ | $y_5(i)$ | $y_5(i)$ |
| $T_7$ | $-k_6$ | $y_6(i)$ | $k_3.b_3(i-1)$ | $y_4(i)$ | $y_4(i)$ |
| $T_8$ | $-k_5$ | $y_5(i)$ | $k_2.b_2(i-1)$ | $y_3(i)$ | $y_3(i)$ |
| $T_9$ | $-k_4$ | $y_4(i)$ | $k_1.b_1(i-1)$ | $y_2(i)$ | $y_2(i)$ |
| $T_{10}$ | $-k_3$ | $y_3(i)$ | $A.u(i)$ | 0 | $y_1(i)$ |
| $T_{11}$ | $-k_2$ | $y_2(i)$ | $-k_9.y_9(i)$ | $b_9(i-1)$ | $B_{11}(i)$ |
| $T_{12}$ | $-k_1$ | $y_1(i)$ | $-k_8.y_8(i)$ | $b_8(i-1)$ | $B_{10}(i)$ |
| $T_{13}$ | $k_{10}$ | $b_{10}(i)$ | $-k_7.y_7(i)$ | $b_7(i-1)$ | $B_9(i)$ |
| $T_{14}$ | $k_9$ | $b_9(i)$ | $-k_6.y_6(i)$ | $b_6(i-1)$ | $B_8(i)$ |
| $T_{15}$ | $k_8$ | $b_8(i)$ | $-k_5.y_5(i)$ | $b_5(i-1)$ | $B_7(i)$ |
| $T_{16}$ | $k_7$ | $b_7(i)$ | $-k_4.y_4(i)$ | $b_4(i-1)$ | $B_6(i)$ |
| $T_{17}$ | $k_6$ | $b_6(i)$ | $-k_3.y_3(i)$ | $b_3(i-1)$ | $B_5(i)$ |
| $T_{18}$ | $k_5$ | $b_5(i)$ | $-k_2.y_2(i)$ | $b_2(i-1)$ | $B_4(i)$ |
| $T_{19}$ | $k_4$ | $b_4(i)$ | $-k_{11}.y_1(i)$ | $b_1(i-1)$ | $B_3(i)$ |
| $T_0$ | $k_3$ | $b_3(i)$ | $k_{10}.b_{10}(i)$ | $b_{11}(i)$ | $B_2(i)$ |

TABLE 3

| Time Period | 2-Delay output | Loss circuit input | Loss circuit output | Shift register output | Latch output |
|---|---|---|---|---|---|
| $T_0$ | $B_4(i-1)$ | $B_2(i-1)$ | $b_3(i-1)$ | $b_{11}(i-1)$ | $y_1(i-1)$ |
| $T_1$ | $B_3(i-1)$ | $y_1(i-1)$ | $b_2(i-1)$ | $b_{10}(i-1)$ | $y_1(i-1)$ |
| $T_2$ | $B_2(i-1)$ | $y_9(i)$ | $b_1(i-1)$ | $b_9(i-1)$ | $y_1(i-1)$ |
| $T_3$ | $y_{10}(i)$ | $y_8(i)$ | $b_1(i-1)$ | $b_9(i-1)$ | $y_1(i-1)$ |
| $T_4$ | $y_9(i)$ | $y_7(i)$ | $b_1(i-1)$ | $b_9(i-1)$ | $y_1(i-1)$ |
| $T_5$ | $y_8(i)$ | $y_6(i)$ | $b_1(i-1)$ | $b_9(i-1)$ | $y_1(i-1)$ |
| $T_6$ | $y_7(i)$ | $y_5(i)$ | $b_1(i-1)$ | $b_9(i-1)$ | $y_1(i-1)$ |
| $T_7$ | $y_6(i)$ | $y_4(i)$ | $b_1(i-1)$ | $b_9(i-1)$ | $y_1(i-1)$ |
| $T_8$ | $y_5(i)$ | $y_3(i)$ | $b_1(i-1)$ | $b_9(i-1)$ | $y_1(i-1)$ |
| $T_9$ | $y_4(i)$ | $y_2(i)$ | $b_1(i-1)$ | $b_9(i-1)$ | $y_1(i-1)$ |
| $T_{10}$ | $y_3(i)$ | $y_1(i)$ | $b_1(i-1)$ | $b_9(i-1)$ | $y_1(i-1)$ |

TABLE 3-continued

| Time Period | 2-Delay output | Loss circuit input | Loss circuit output | Shift register output | Latch output |
|---|---|---|---|---|---|
| $T_{11}$ | $y_2$ (i) | $B_{11}$(i) | $b_1$ (i−1) | $b_9$ (i−1) | $y_1$ (i−1) |
| $T_{12}$ | $y_1$ (i) | $B_{10}$(i) | $b_{11}$(i) | $b_8$ (i−1) | $y_1$ (i−1) |
| $T_{13}$ | $B_{11}$(i) | $B_9$ (i) | $b_{10}$(i) | $b_7$ (i−1) | $y_1$ (i) |
| $T_{14}$ | $B_{10}$(i) | $B_8$ (i) | $b_9$ (i) | $b_6$ (i−1) | $y_1$ (i) |
| $T_{15}$ | $B_9$ (i) | $B_7$ (i) | $b_8$ (i) | $b_5$ (i−1) | $y_1$ (i) |
| $T_{16}$ | $B_8$ (i) | $B_6$ (i) | $b_7$ (i) | $b_4$ (i−1) | $y_1$ (i) |
| $T_{17}$ | $B_7$ (i) | $B_5$ (i) | $b_6$ (i) | $b_3$ (i−1) | $y_1$ (i) |
| $T_{18}$ | $B_6$ (i) | $B_4$ (i) | $b_5$ (i) | $b_2$ (i−1) | $y_1$ (i) |
| $T_{19}$ | $B_5$ (i) | $B_3$ (i) | $b_4$ (i) | $b_1$ (i−1) | $y_1$ (i) |
| $T_0$ | $B_4$ (i) | $B_2$ (i) | $b_3$ (i) | $b_{11}$ (i) | $y_1$ (i) |

TABLE 4

| | | TIME PERIOD | | | | | | | | | |
|---|---|---|---|---|---|---|---|---|---|---|---|
| | Output | $T_0$ | $T_1$ | $T_2$ | $T_3$ | $T_4$ | $T_5$ | $T_6$ | $T_7$ | $T_8$ | $T_9$ |
| BIT | Terminal | $T_{10}$ | $T_{11}$ | $T_{12}$ | $T_{13}$ | $T_{14}$ | $T_{15}$ | $T_{16}$ | $T_{17}$ | $T_{18}$ | $T_{19}$ |
| LSB | 25F-1 | $k_3$ | $k_2$ | $k_1$ | $\overset{A}{k_{10}}$ | $k_9$ | $k_8$ | $k_7$ | $k_6$ | $k_5$ | $k_4$ |
| | 25F-2 | $k_3$ | $k_2$ | $k_1$ | $\overset{A}{k_{10}}$ | $k_9$ | $k_8$ | $k_7$ | $k_6$ | $k_5$ | $k_4$ |
| | 25F-3 | $k_3$ | $k_2$ | $k_1$ | $\overset{A}{k_{10}}$ | $k_9$ | $k_8$ | $k_7$ | $k_6$ | $k_5$ | $k_4$ |
| | 25F-4 | $k_3$ | $k_2$ | $k_1$ | $k_{10}$ | $\overset{A}{k_9}$ | $k_8$ | $k_7$ | $k_6$ | $k_5$ | $k_4$ |
| | 25F-5 | $k_4$ | $k_3$ | $k_2$ | $k_1$ | $\overset{A}{k_{10}}$ | $k_9$ | $k_8$ | $k_7$ | $k_6$ | $k_5$ |
| | 25F-6 | $k_4$ | $k_3$ | $k_2$ | $k_1$ | $k_{10}$ | $\overset{A}{k_9}$ | $k_8$ | $k_7$ | $k_6$ | $k_5$ |
| | 25F-7 | $k_5$ | $k_4$ | $k_3$ | $k_2$ | $k_1$ | $\overset{A}{k_{10}}$ | $k_9$ | $k_8$ | $k_7$ | $k_6$ |
| | 25F-8 | $k_5$ | $k_4$ | $k_3$ | $k_2$ | $k_1$ | $k_{10}$ | $\overset{A}{k_9}$ | $k_8$ | $k_7$ | $k_6$ |
| | 25F-9 | $k_6$ | $k_5$ | $k_4$ | $k_3$ | $k_2$ | $k_1$ | $\overset{A}{k_{10}}$ | $k_9$ | $k_8$ | $k_7$ |
| MSB | 25F-10 | $k_6$ | $k_5$ | $k_4$ | $k_3$ | $k_2$ | $k_1$ | $k_{10}$ | $k_9$ | $k_8$ | $k_7$ |

What is claimed is:

1. A speech synthesizer comprising:

a first memory for storing partial autocorrelation coefficient and amplitude information derived from a frequency spectrum of a speech signal;

a multiplier having a pair of input terminals and an output terminal, an output signal of said first memory being applied to a first one of said pair of input terminals of said multiplier, an adder/subtractor having a pair of input terminals and an output terminal, an output signal of said multiplier being applied to a first one of said pair of input terminals of said adder/subtractor, a shift register adapted to receive an output signal of said adder/subtractor, a latch circuit adapted to receive an output signal of said shift register and having a control terminal for controlling read-in of an input signal thereto, a first switch for selecting either the output signal of said adder/subtractor or the output signal of said latch circuit, a loss circuit for multiplying a constant to the output signal selected by said first switch, a second memory for storing an output signal of said loss circuit, a second switch for selecting either one of an input signal, the output signal of said shift register or the output signal of said loss circuit for supplying the selected signal to a second one of said pair of input terminals of said multiplier, means for supplying the output signal of said adder/subtractor and an output signal of said second memory to a second one of said pair of input terminals of said adder/subtractor, and means for supplying the output signal of said latch circuit to an output terminal.

2. A speech synthesizer according to claim 1 wherein said loss circuit is adapted to add the input signal thereto to a signal derived by inverting said input signal and then shifting the inverted signal by n-bit positions ($n \geqq 1$) toward the least significant bit position, to produce the output signal.

* * * * *